US006117801A

United States Patent [19]

McGinty et al.

[11] Patent Number: 6,117,801

[45] Date of Patent: Sep. 12, 2000

[54] PROPERTIES FOR FLASH-SPUN PRODUCTS

[75] Inventors: David Jackson McGinty, Midlothian, Va.; Hyunkook Shin, Wilmington; Young H. Kim, Hockessin, both of Del.

[73] Assignee: E. I. du Pont de Nemours and Company, Wilmington, Del.

[21] Appl. No.: 08/825,271

[22] Filed: Mar. 27, 1997

[51] Int. Cl.[7] ..... D04H 3/00

[52] U.S. Cl. ..... 442/352; 442/339; 442/340; 442/401

[58] Field of Search ..... 442/339, 340, 442/352, 401

[56] References Cited

U.S. PATENT DOCUMENTS

| | | | |
|---|---|---|---|
| 3,081,510 | 3/1963 | Klein et al. | 28/1 |
| 3,227,784 | 1/1966 | Blades et al. | 264/53 |
| 3,227,794 | 1/1966 | Anderson et al. | 264/205 |
| 3,920,874 | 11/1975 | Dempsey et al. | 428/198 |
| 5,081,177 | 1/1992 | Shin . | |
| 5,192,468 | 3/1993 | Coates et al. . | |
| 5,272,236 | 12/1993 | Lai et al. | 526/348.5 |
| 5,278,272 | 1/1994 | Lai et al. | 526/348.5 |
| 5,322,728 | 6/1994 | Davey et al. | 428/296 |
| 5,415,818 | 5/1995 | Cloutier et al. | 264/13 |
| 5,436,074 | 7/1995 | Shimura et al. | 428/369 |

FOREIGN PATENT DOCUMENTS

| | | | |
|---|---|---|---|
| WO 91/13193 | 9/1991 | WIPO | D01F 6/04 |
| WO 94/25647 | 11/1994 | WIPO . | |

*Primary Examiner*—Deborah Jones
*Assistant Examiner*—Jason Savage

[57] ABSTRACT

This invention relates to flash spinning copolymers which provide softness and quietness to nonwoven sheet structures formed of plexifilamentary film-fibril material. In particular, flash spinning polyethylene with an ethylene copolymer provides a substantial improvement in softness and quietness.

16 Claims, 4 Drawing Sheets

PROPERTIES FOR FLASH-SPUN PRODUCTS

FIELD OF THE INVENTION

This invention relates to flash-spun products and more particularly to fibers and sheet products made by flash spinning.

BACKGROUND OF THE INVENTION

E. I. du Pont de Nemours (DuPont) has been manufacturing Tyvek® spunbonded olefin sheet products for a number of years. During this time, DuPont has developed two basic styles of flash-spun nonwoven sheet products: area bonded material and point bonded material. Area bonded material is thermally bonded generally uniformly across the area of the sheet. Point or pattern bonded material is thermally bonded at points or in a pattern where the pattern creates portions which are more strongly bonded and not as strongly bonded. As such, area bonded products are typically stiffer than point bonded and have a paper-like feel. Point bonded flash-spun nonwoven products tend to have softer fabric-like feel. Point bonded flash-spun material is most commonly used in protective apparel. Area bonded products are used in envelopes, medical packaging and air infiltration barriers in construction applications.

Focusing on protective apparel, the comfort of the wearer is a factor that takes into consideration a lot of properties of the sheet material. DuPont has done much development work to increase breathability and strength of the flash-spun nonwoven materials. One consideration that is commonly recognized but difficult to measure is softness or hand. Softness is one of the key fabric properties influencing comfort. Improved softness for flash-spun nonwoven fabrics without diminishing other properties would be recognized as an upgrade or improvement that would be appreciated by customers or users. Another interesting property for apparel is its quietness or noisiness. Garments, such as protective apparel, made of fabrics which make noise as the wearer moves are perceived as uncomfortable.

It is believed that added softness would also be favorably received for area bonded materials. In particular, area bonded flash-spun nonwoven materials tend to be somewhat noisy when flexed. In some construction applications, the air barrier may not be fully restricted from movement when exposed to pressure changes such as from a door opening or closing. The audible rippling of the air infiltration barrier would not be desirable. Thus, again, a softer product may reduce or eliminate the noise associated with a paper like sheet material.

SUMMARY OF THE INVENTION

The objects of the invention are accomplished by a polymeric flash-spun plexifilamentary film-fibril material wherein the polymer comprises one or more ethylene copolymers either alone or blended with high density polyethylene. The ethylene copolymers in the invention have a density from about 0.85 to about 0.95 g/cc and a melt index from about 0.1 to about 50 g/10 min measured at a temperature of 190° C. with a 2.16 kg weight. The flash-spun plexifilamentary film-fibril material has a BET surface area greater than about 2 $m^2$/gm.

BRIEF DESCRIPTION OF THE DRAWINGS

The invention will be more easily understood by a detailed explanation of the invention including drawings. Accordingly, drawings which are particularly suited for explaining the invention are attached herewith; however, it should be understood that such drawings are for explanation only and are not necessarily to scale. The drawings are briefly described as follows.

DETAILED DESCRIPTION OF THE PREFERRED EMBODIMENT

Figure 1:
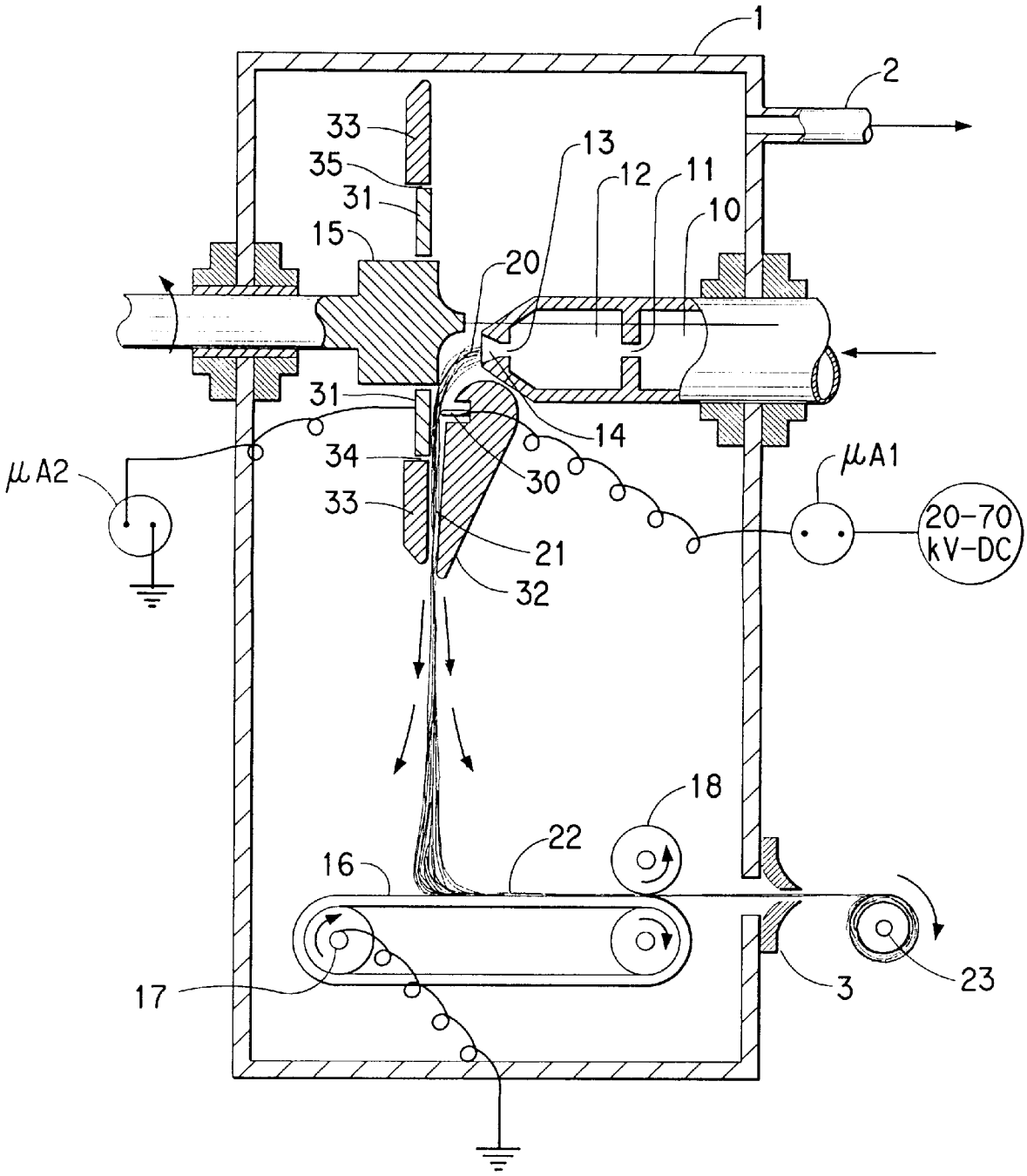
FIG. 1 is a schematic view of an apparatus suitable in the process of flash spinning polymer into a plexifilamentary web and laying down the plexifilamentary web to form a nonwoven sheet.
Figure 2:
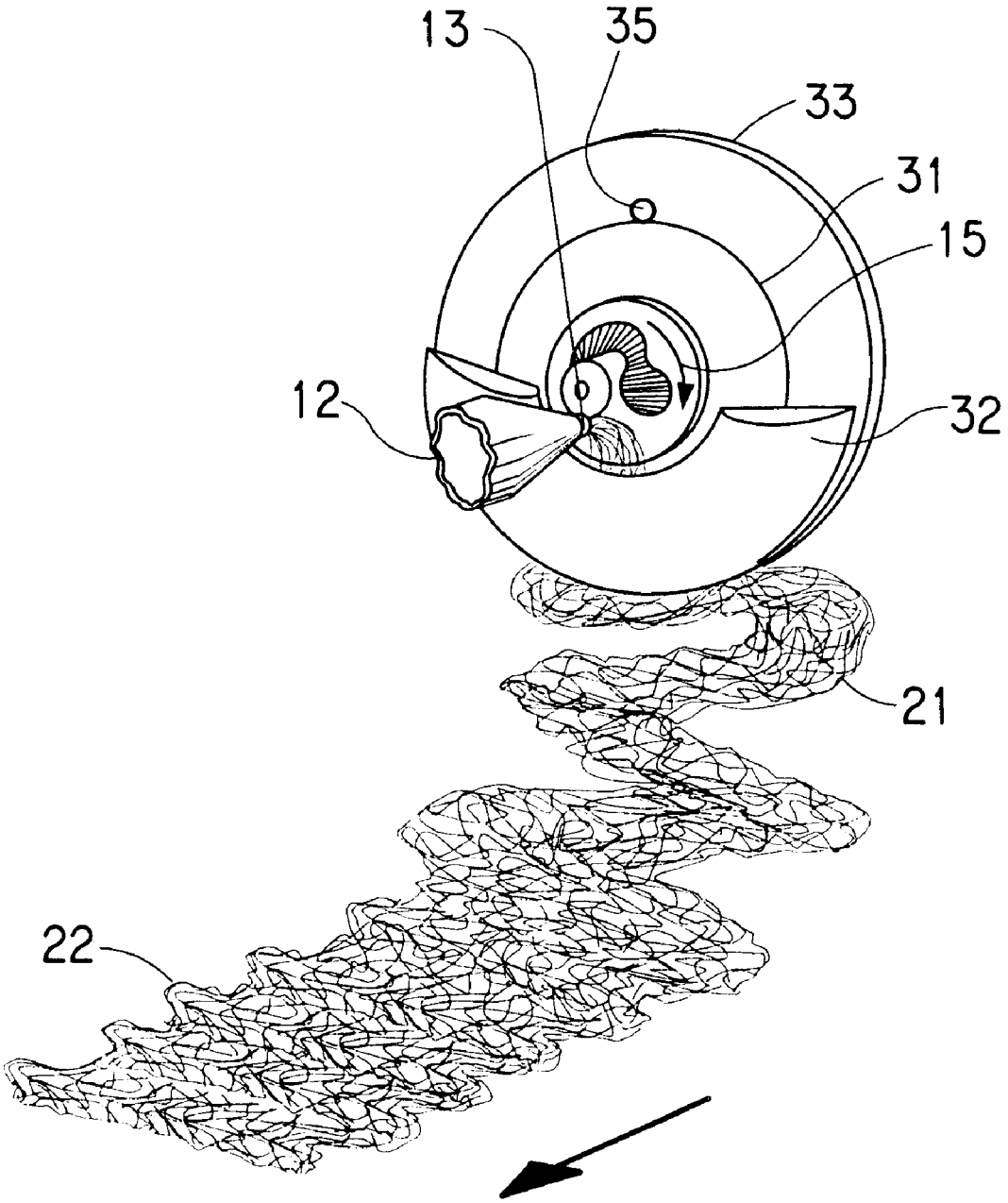
FIG. 2 is a fragmentary perspective view of the laydown of the plexifilamentary web in FIG. 1.
Figure 3:
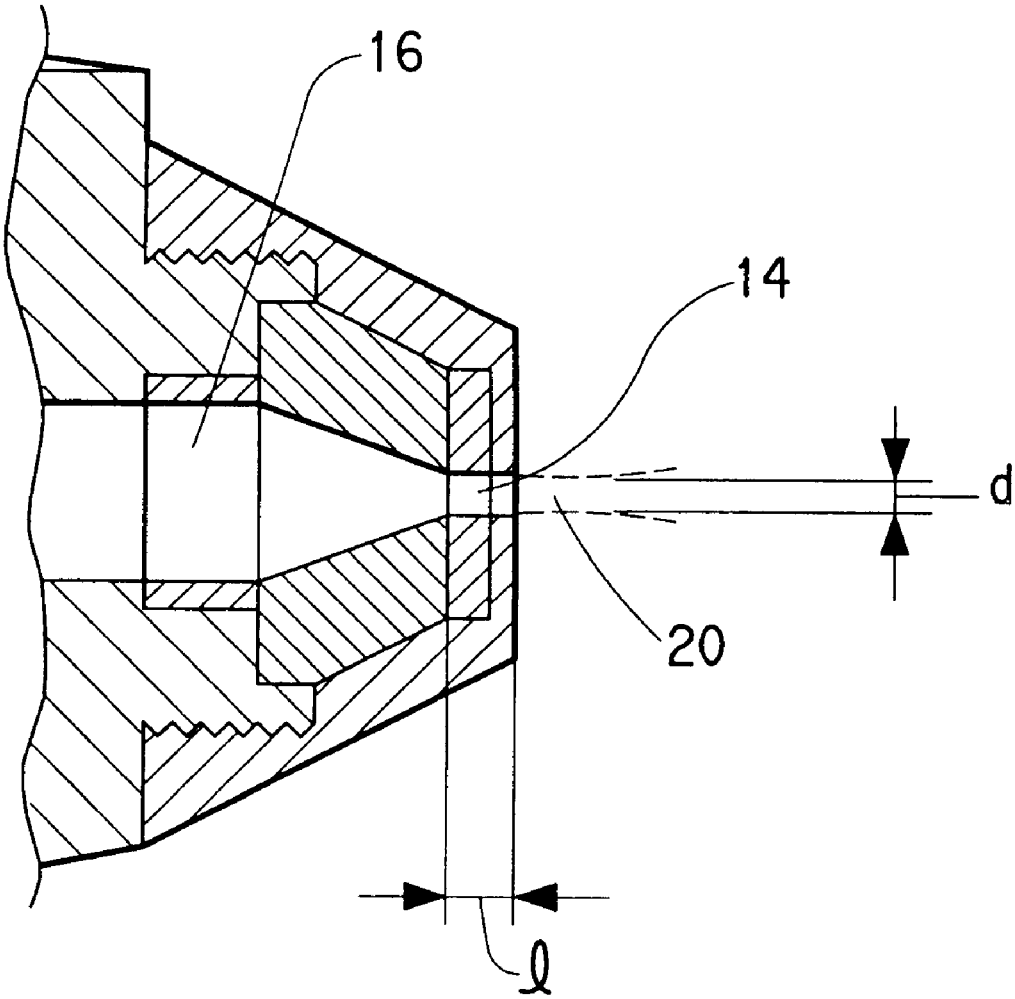
FIG. 3 is an enlarged cross sectional view of the letdown chamber and spin orifice in the apparatus in FIG. 1.

Referring now to the drawings, a preferred system and process for flash spinning fibers and forming sheets is illustrated in FIGS. 1 and 2. The basic system has been previously disclosed in U.S. Pat. No. 3,860,369 to Brethauer et al., which is hereby incorporated by reference. The process is conducted in a chamber 1, sometimes referred to as a spin cell by those in the industry, which has a vapor-removal port 2 and an opening 3 through which non-woven sheet material produced in the process is removed. Polymer solution (or spin liquid) is continuously or batchwise prepared at an elevated temperature and pressure and provided to the spin cell 1 via a conduit 10. The pressure of the solution is greater than cloud-point pressure which is the lowest pressure at which the polymer is fully dissolved in the spin agent forming a homogeneous single phase mixture.

The single phase polymer solution passes through a letdown orifice 11 into a lower pressure (or letdown) chamber 12. In the lower pressure chamber 12, the solution separates into a two-phase liquid-liquid dispersion. One phase of the dispersion is a spin agent-rich phase which comprises primarily spin agent and the other phase of the dispersion is a polymer-rich phase which contains most of the polymer. This two phase liquid-liquid dispersion is forced through a spinneret 13 into an area of much lower pressure (preferably atmospheric pressure) where the spin agent evaporates very rapidly (flashes), and the polyolefin emerges from the spinneret as a yarn (or plexifilament) 20. The yarn 20 is stretched in a tunnel 14 and is directed to impact a rotating baffle 15. The rotating baffle 15 has a shape that transforms the yarn 20 into a flat web 21, which is about 5–15 cm wide, and separating the fibrils to open up the web 21. The rotating baffle 15 further imparts a back and forth oscillating motion having sufficient amplitude to generate a wide back and forth swath. The web 21 is laid down on a moving wire laydown belt 16 located about 50 cm below the spinneret 13, and as best seen in FIG. 2, the back and forth oscillating motion is arranged to be generally across the belt 16 to form a sheet 22.

As the web 21 is deflected by the baffle 15 on its way to the moving belt 16, it enters a corona charging zone between a stationary multi-needle ion gun 30 and a grounded rotating target plate 31. The multi-needle ion gun 30 is charged to a DC potential of by a suitable voltage source 36. The charged web 21 is carried by a high velocity spin agent vapor stream through a diffuser consisting of two parts: a front section 32 and a back section 33. The diffuser controls the expansion of the web 21 and slows it down. The back section 33 of the diffuser may be stationary and separate from target plate 31, or it may be integral with it. In the case where the back section 33 and the target plate 31 are integral, they rotate together. FIG. 1 shows the target plate 31 and the back section 33 of the diffuser as a single unit. Aspiration holes 34 and 35 are drilled in the back section 33 of the diffuser to assure adequate flow of gas between the moving web 21 and the diffuser back section 33 to prevent sticking of the moving web 21 to the diffuser back section 33. The moving belt 16 is grounded through roll 17 so that the charged web 21 is electrostatically attracted to the belt 16 and held in place thereon. Overlapping web swaths collected on the moving belt 16 and held there by electrostatic forces are formed into a sheet 22 with a thickness controlled by the belt speed. The sheet 22 is compressed between belt 16 and consolidation roll 18 into a structure having sufficient strength to be handled outside the chamber 1 and then collected outside the chamber 1 on a windup roll 23.

Flash-spun nonwoven sheets made by a process similar to the foregoing process are sold as Tyvek® spunbonded olefin sheets for air infiltration barriers in construction applications, as packaging such as air express envelopes, as medical packaging, as banners, and for protective apparel and other uses. Tyvek® spunbonded olefin is quite strong and lightweight with small interstices between the fibers to allow moisture vapor and air to permeate the sheet but limit passage of liquid water.

Thus, the properties of Tyvek® spunbonded olefin is of considerable interest and importance for its various end uses. It should go without saying that it is always desirable to improve the properties of flash-spun products as long as there is not a sacrifice of other important properties. As described in many prior patent applications on flash spinning, a myriad of variations have been disclosed that lead to variations in properties of flash-spun fabrics.

One important set of properties of Tyvek® spunbonded olefin sheet is its considerable tensile strength especially considering that it is made of high density polyethylene. Flash spinning tends to provide highly oriented polymer in the plexifilaments. While flash spinning provides good tensile properties, improved tensile properties as well as elongation and toughness would be appreciated in the market place. Elongation is a measure of the amount the product stretches before it breaks. Work to Break (WTB) relates to both the elongation and tensile strength. The WTB is the area under the stress-strain curve. Toughness is the WTB normalized for the basis weight.

DuPont has relied solely upon high density homopolymer polyethylene for all commercial operations in its Tyvek business and, indeed, the polyethylene used was specified from specific sources with very tight specifications. Recently, however, DuPont has begun to add post consumer recycled high density polyethylene to virgin polymer. The post consumer recycle is primarily from recycled milk jugs. Considerable engineering has gone into the system and process to accommodate the recycled materials, and the company is quite proud of this accomplishment.

With its new found ability to accommodate what would have previously been considered very off-specification polyethylene, new types of polymer are being considered with the belief that new polymers may provide better economics of production or provide different product properties. It has now been found that copolymers of ethylene other monomers provide considerably improved softness without compromising other important properties.

The polymers that have been found to be useful for this invention include ethylene copolymers and blends of ethylene copolymers with high density polyethylene. The ethylene copolymers which are particularly useful for this invention include those containing polymerized units of alpha olefins such as butene, hexene and octene. These ethylene copolymers can be prepared by using conventional Ziegler-Natta catalysts or single site catalysts. Some of the commercially available ethylene copolymers that can be used include linear low density polyethylene (LLDPE) and plastomers, such as those sold by Dow under the tradenames of "Affinity", "Engage" and "ASPUN" and those sold by Exxon under the tradenames of "Exact" and "Exceed". Most of the above ethylene copolymers have a molecular weight distribution of less than 4 with some approaching 2. All of the samples tested below had a MWD of less than 4.

For purposes of clarity of meaning, in this application and especially in the claims, polyethylene shall mean a polymer comprised entirely or nearly entirely of ethylene monomer with no more than to a small portion of alpha-olefin comonomer units polymerized therein. High density polyethylene shall mean polyethylene having a density greater than about 0.935.

Example cases were prepared to illustrate that suitable flash-spun products can be made with improved softness. A small scale test device shown in FIG. 4 is used to make flash-spun fiber which can be tested and compared to other polymers to predict properties in nonwoven sheets.

Figure 4:
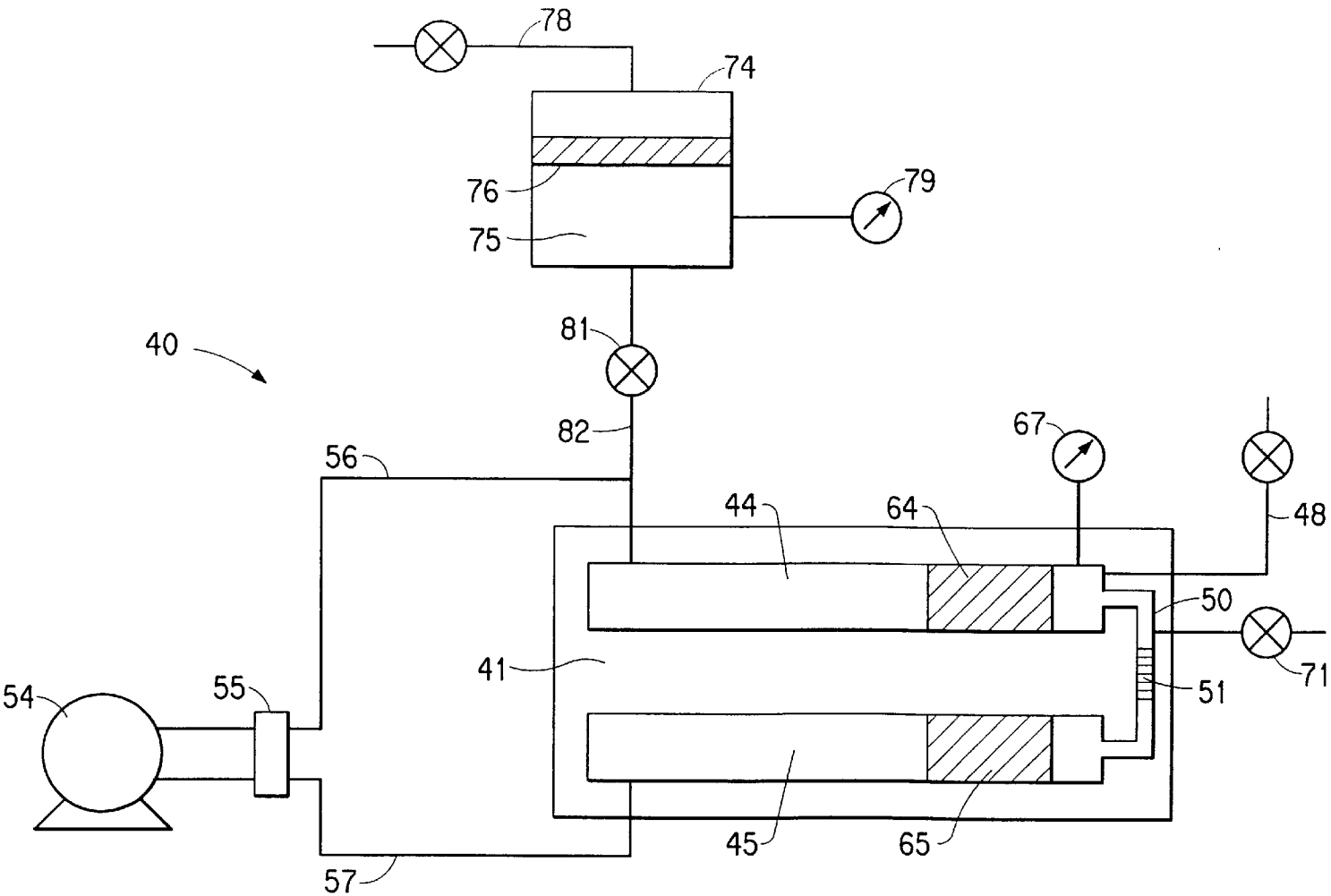
FIG. 4 is a schematic view of a small scale test system for making plexifilamentary yarn from polymer.

Turning now to FIG. 4, there is illustrated a twin cell test device 40 for mixing polymer and spin agent into a spin mixture. The device 40 comprises a block 41 which includes a primary cylinder chamber 44 and second cylinder chamber 45. Measured quantities of polymer and spin agent are provided into the primary cylinder chamber 44 through a suitable access such as port 48. The polymer and spin agent are directed back and forth between the primary cylinder chamber 44 and the second cylinder chamber 45 through passage 50 which includes a static mixer element 51. Pressurized hydraulic fluid from hydraulic pump 54 via hydraulic valve 55 and hydraulic lines 56 and 57 causes pistons 64 and 65 to move the polymer and spin agent between the two chambers 44 and 45. The mixture is heated to a predetermined temperature and the pressure is monitored at sensor 67 until the polymer and spin agent are adequately mixed. The hydraulic system is then operated to direct the solution into the primary cylinder chamber 44 whereupon the valve 55 is closed to lock the secondary piston 65 closest to the passage 50. The hydraulic valve 55 is also closed to preclude hydraulic fluid from passing from line 56 back into the pump 54.

The spin solution now in the primary chamber 44 is spun through a valve 71 using an accumulator 74 to maintain relatively constant spin pressure. The accumulator 74 includes a relatively large cylinder 75 (compared to either of the primary and second cylinder chambers 44 and 45) with a piston 76. Hydraulic fluid (preferably water) fills a large portion of the accumulator cylinder 75, and pressurized gas fills the space in the accumulator cylinder 75 on other side of the piston 76. The pressurized gas provided through a gas line 78 from a suitable source is controlled to create a nearly constant accumulator pressure during the spin which lasts a few seconds. The accumulator pressure is monitored at sensor 79. With the twin cell test device 40, there are several items to consider when comparing the operational parameters to the operation of the standard arrangement shown in FIG. 1. The pressure letdown chamber disclosed by Anderson et al. (U.S. Pat. No. 3,227,794) was not used in the examples, and instead, the accumulator pressure is set at the end of the mixing cycle to the desired spin pressure to simulate the letdown chamber effect. Also, the valve 81 in hydraulic line 82 between the spin cell and the accumulator and the spinneret orifice 71 are opened in rapid succession. The resultant flash-spun product is collected in a stainless steel open mesh screen basket. Because of the relatively small amount of material and high pressure used, most of the spins in these Examples lasted for only about one second.

It usually takes about one to two seconds to open the spinneret orifice 71 after opening the valve 81 between the spin cell and the accumulator. When letdown chambers are used, the residence time in the chamber is usually 0.2 to 0.8 seconds. However, it has been determined that residence time does not have too much effect on fiber morphology and/or properties as long as it is greater than about 0.1 second but less than about 10 seconds. When the valve between the spin cell and the accumulator is opened, the pressure inside the spin cell drops immediately from the mixing pressure to the accumulator pressure. The spin cell pressure drops again when the spinneret orifice is opened because of the pressure drop in the line. The pressure measured during spinning just before the spinneret with a pressure transducer using a computer is entered as the spin pressure in the examples. It is usually lower than the set accumulator pressure by about 100 to 200 psi. Therefore, the quality of the two phase dispersion in the spin cell depends on both the accumulator pressure and the actual spin pressure, and the time at those pressures. Sometimes the accumulator pressure is set at a pressure higher than the cloud point pressure. In this case, the quality of the two phase dispersion in the spin cell will be determined primarily by the spin pressure reached after the spinneret orifice is opened.

In some of the examples that follow, an ethylene copolymer is blended with high-density polyethylene (HDPE). The HDPE that was used had a melt index of about 0.73 g/10 minutes (@109° C. with 2.16 kg weight), a melt flow ratio {MI (@190° C. with 2.16 kg weight)/MI (@190° C. with 21.6 kg weight)} of about 42, and a density of about 0.955 g/cc. The HDPE was obtained from Lyondell Petrochemical Company of Houston, Texas under the tradename ALATHON®. ALATHON® is currently a registered trademark of Lyondell Petrochemical Company.

There are a number of tests and other measured parameters such as the tensile, elongation, and work to break measurements taken on fibers, yarn and sheets. Several of the tests and test methods are described hereafter to provide a brief description of a number of the tests and measured parameters.

Melt Index

Melt index is measured according to ASTM D1238-90A, which is hereby incorporated by reference, at a temperature of 190° C. with a 2.16 kg weight and is expressed in units of g/10 minutes.

Concentration

Polymer/spin agent concentration and copolymer/homopolymer concentration are measured as weight percent.

Surface Area

Surface area for flash-spun polyethylene typically is in the range of 10 to 50 $m^2$/gm. This is considerably higher than other fiber spinning technologies and provides the high opacity typically desired in nonwoven sheet products. The surface area of the plexifilamentary film-fibril strand is measured by the BET nitrogen absorption method of S. Brunauer, P. H. Emmett and E. Teller, J. Am. Chem. Soc., V. 60 p 309–319 (1938), which is hereby incorporated by reference, and is reported as $m^2$/g. While surface area was not measured for the samples discussed below, based on visual observation by experienced personnel, it can be reported that the samples below were in the typical surface area range for flash-spun products of 10 to 50 $m^2$/gm.

Twin Cell Plexifilament Yarn Tensile Test Methods

Denier of the flash-spun strand is determined as follows: One 90 cm long strand of yarn is cut, and a weight of 20 grams is hung on one end of the yam for 3 minutes to remove bends and waviness. From the long single yarn strand, five 18 cm individual pieces are cut, and denier is determined for each piece.

Tenacity, elongation and toughness of the strand are determined with an Instron tensile-testing machine. The strands are conditioned and tested at 70 F and 65% relative humidity. The strands are then twisted to 10 turns per inch and mounted in the jaws of the Instron Tester. A two-inch gauge length is used with an elongation rate of 2 inches per minute. The tenacity at break is recorded in grams per denier (gpd). The elongation at break is recorded as a percentage of the two-inch gauge length of the sample. Toughness is the work required to break the sample divided by the denier of the sample and is recorded in gpd. Modulus corresponds to the slope of the stress/strain curve and is expressed in units of gpd.

Basis Weight

Basis weight is determined by ASTM D-3776, which is hereby incorporated by reference, and is reported in oz/$yd^2$ (g/$m^2$) The basis weights reported for the examples below are each based on an average of at least six measurements made on the sheet.

Delamination Strength

Delamination strength of a sheet sample is measured using a constant rate of extension tensile testing machine such as an Instron table model tester. A 1.0 in. (2.54 cm) by 8.0 in. (20.32 cm) sample is delaminated approximately 1.25 in. (3.18 cm) by inserting a pick into the cross section of the sample to initiate a separation and delamination by hand. The delaminated sample faces are mounted in the clamps of the tester which are set 1.0 in. (2.54 cm) apart. The tester is started and run at a cross-head speed of 5.0 in./min. (12.7 cm/min.). The computer starts picking up force readings after the slack is removed in about 0.5 in. of crosshead travel. The sample is delaminated for about 6 in. (15.24 cm) during which 3000 force readings are taken and averaged. The average delamination strength is the average force divided by the sample width and is expressed in units of lb/in (N/cm). The test generally follows the method of ASTM D 2724-87, which is hereby incorporated by reference. The delamination strength values reported for the examples below are each based on an average of at least six measurements made on the sheet.

Opacity

Opacity is measured according to TAPPI T-519 om-86, which is hereby incorporated by reference. The opacity is the reflectance from a single sheet against a black background compared to the reflectance from a white background standard and is expressed as a percent. The opacity values reported for the examples below are each based on an average of at least six measurements made on the sheet.

Grab Tensile

Tensile properties are determined by ASTM D1682, Section 19, which is hereby incorporated by reference, with the following modifications. In the test a 2.54 cm by 20.32 cm (1 inch by 8 inch) sample was clamped at opposite ends of the sample. The sample was pulled steadily at a speed of 5.08 cm/min (2 in/min) until the sample broke. The tensile property values reported for the examples below were each an average of six measurements on specimens cut in the machine direction and six measurements on specimens cut in the cross direction. The force at break was normalized by dividing by the samples basis weight and was recorded in lb-yd$^2$/(oz-in) (Newtons-m$^2$/(g-cm)) as the breaking strength. The elongation at 13.34 Newtons (3 lb) load and the elongation at break were recorded as a percent of the original sample length. The Work-to-Break (WTB), which is the area under the stress-strain curve, was normalized by dividing by the sample basis weight and the sample width and is reported as toughness in lb-yd$^2$/oz (N-m$^2$/g).

Spencer Puncture

Spencer puncture is measured according to ASTM D3420-91 Procedure B, which is hereby incorporated by reference, with the exception that an impact head with contact area of 0.35 square inches was used on a modified Elmendorf tester having a capacity of 6400 gram-force. Results are normalized by dividing the measured energy to rupture by the area of the impact head and reported in units of in-lb/in$^2$ (J/cm$^2$). The results below are each based on an average of at least six measurements on the sheet.

Elmendorf Tear

Elmendorf tear strength is measured according to ASTM D1424, which is hereby incorporated by reference. The Elmendorf tear values are reported for the examples below.

Softness and Quietness

A subjective softness scale was created to provide a general comparison of softness for the various yarns and sheets. For both scales, a softness of 1 was established for the control which was not very soft. For the yams, the softest were given a rating of 5. For the sheets, the softest were given a rating of 7. The sheets were also evaluated for quietness with the control and noisiest having a rating of 1 with the optimal rating being 7.

With the twin cell system 40 of FIG. 4, flash-spun yarn were created with a 20% weight solution of polymer in normal pentane spin agent. In some tests, a tunnel A was used which is generally cylindrical having a diameter of 0.2 inches and a length of 0.1 inches. An alternative generally cylindrical tunnel B was also used having a diameter of 0.15 inches and a length of 0.1 inches. In other arrangements, no tunnel was used. The following data was collected:

| | Ex. 1 | Ex. 2 | Ex. 3 | Ex. 4 |
|---|---|---|---|---|
| Copolymer | | | | |
| Density (g/cc) | 0.935 | 0.915 | 0.908 | 0.91 |
| Melt Index (g/10 min) | 2.5 | 1 | 1 | 3.5 |
| Comonomer | Octene | Octene | Octene | Octene |
| % comonomer | 2.5 | 7.5 | 9.5 | 9.5 |
| DSC melting point (° C.) | 121 | 108 | 103 | 103 |
| % HDPE blended | 0 | 0 | 0 | 0 |
| Spin Conditions | | | | |
| Tunnel (A/B/None) | A | B | B | A |
| Accum pressure (psig) | 1650 | 1400 | 1350 | 1375 |
| Spin pressure (psig) | 1525 | 1300 | 1250 | 1275 |
| Spin Temperature (° C.) | 176 | 176 | 176 | 176 |
| Properties | | | | |
| Denier | 214 | 179 | 184 | 170 |
| Modulus (gpd) | 1.48 | 1.22 | 1.13 | 0.82 |
| Tensile (gpd) | 1.25 | 1.18 | 1.28 | 0.87 |
| Elongation (%) | 157 | 89 | 97 | 108 |
| Softness Rating (1–5) | 4 | 5 | 5 | 5 |

-continued

| | Ex. 5 | Bx.6 | Ex. 7 | Ex. 8 |
|---|---|---|---|---|
| Copolymer | | | | |
| Density (g/cc) | 0.902 | 0.902 | 0.915 | 0.915 |
| Melt Index (g/10 min) | 1 | 1 | 1 | 1 |
| Comonomer | Octene | Octene | Octene | Octene |
| % comonomer | 12 | 12 | 7.5 | 7.5 |
| DSC melting point (° C.) | 100 | 100 | 108 | 108 |
| % HDPE blended | 0 | 0 | 50 | 70 |
| Spin Conditions | | | | |
| Tunnel (A/B/None) | None | A | A | A |
| Accum pressure (psig) | 1250 | 1250 | 1525 | 1575 |
| Spin pressure (psig) | 1160 | 1160 | 1350 | 1430 |
| Spin Temperature (° C.) | 177 | 176 | 176 | 176 |
| Properties | | | | |
| Denier | 239 | 210 | 237 | 270 |
| Modulus (gpd) | 0.6 | 0.41 | 3.4 | 4.17 |
| Tensile (gpd) | 1.13 | 1.08 | 2.54 | 2.95 |
| Elongation (%) | 116 | 140 | 86 | 89 |
| Softness Rating (1–5) | 5 | 5 | 2.5 | 2 |

| | Ex. 9 | Ex. 10 | Ex. 11 | Ex. 12 |
|---|---|---|---|---|
| Copolymer | | | | |
| Density (g/cc) | 0.915 | 0.902 | 0.902 | 0.902 |
| Melt Index (g/10 min) | 1 | 1 | 1 | 1 |
| Comonomer | Octene | Octene | Octene | Octene |
| % comonomer | 7.5 | 12 | 12 | 12 |
| DSC melting point (° C.) | 108 | 100 | 100 | 100 |
| % HDPE blended | 30 | 50 | 70 | 30 |
| Spin Conditions | | | | |
| Tunnel (A/B/None) | B | A | A | A |
| Accum pressure (psig) | 1600 | 1500 | 1550 | 1450 |
| Spin pressure (psig) | 1450 | 1375 | 1425 | 1325 |
| Spin Temperature (° C.) | 175 | 176 | 176 | 176 |
| Properties | | | | |
| Denier | 177 | 239 | 276 | 266 |
| Modulus (gpd) | 1.41 | 1.99 | 1.74 | 0.97 |
| Tensile (gpd) | 1.59 | 2.17 | 2.49 | 1.54 |
| Elongation (%) | 94 | 80 | 83 | 101 |
| Softness Rating (1–5) | 3 | 2.5 | 2 | 2 |

| | Ex. 13 | Ex. 14 | Ex. 15 | Ex. 16 |
|---|---|---|---|---|
| Copolymer | | | | |
| Density (g/cc) | 0.87 | 0.87 | 0.868 | 0.87 |
| Melt Index (g/10 min) | 1 | 0.5 | 5 | |
| Comonomer | Octene | Octene | Octene | Octene |
| % comonomer | 24 | 24 | 25 | 24 |
| DSC melting point (° C.) | | | | |
| % HDPE blended | 90 | 80 | 90 | 90 |
| Spin Conditions | | | | |
| Tunnel (A/B/None) | A | A | A | A |
| Accum pressure (psig) | 1600 | 1550 | 1600 | 1600 |
| Spin pressure (psig) | 1450 | 1380 | 1425 | 1425 |
| Spin Temperature (° C.) | 176 | 176 | 176 | 175 |
| Properties | | | | |
| Denier | 262 | 236 | 255 | 246 |
| Modulus (gpd) | 3.74 | 2.58 | 3.77 | 7.69 |
| Tensile (gpd) | 1.98 | 2.18 | 1.83 | 3.28 |
| Elongation (%) | 54 | 61 | 50 | 55 |
| Softness Rating (1–5) | 1.5 | 2 | 1.5 | 1.5 |

| | Ex. 17 | Ex. 18 | Ex. 19 | Ex. 20 |
|---|---|---|---|---|
| Copolymer | | | | |
| Density (g/cc) | 0.91 | 0.91 | 0.91 | 0.91 |
| Melt Index (g/10 min) | 1.2 | 1.2 | 1.2 | 1.2 |

-continued

| | | | | |
|---|---|---|---|---|
| Comonomer | Butene | Butene | Butene | Butene |
| % comonomer | | | | |
| DSC melting point (° C.) | 103 | 103 | 103 | 103 |
| % HDPE blended | 0 | 0 | 0 | 0 |
| Spin Conditions | | | | |
| Tunnel (A/B/None) | None | B | None | A |
| Accum pressure (psig) | 1500 | 1600 | 1700 | 1600 |
| Spin pressure (psig) | 1425 | 1475 | 1500 | 1460 |
| Spin Temperature (° C.) | 176 | 176 | 176 | 176 |
| Properties | | | | |
| Denier | 235 | 211 | 262 | 238 |
| Modulus (gpd) | 0.88 | 1.39 | 0.77 | 0.51 |
| Tensile (gpd) | 1.23 | 1.53 | 1.14 | 1.11 |
| Elongation (%) | 79 | 93 | 94 | 1 12 |
| Softness Rating (1–5) | 4 | 4 | 4 | 4 |

| | Ex. 21 | Ex. 22 | Ex. 23 | Ex. 24 |
|---|---|---|---|---|
| Copolymer | | | | |
| Density (g/cc) | 0.91 | 0.91 | 0.91 | n/a |
| Melt Index (g/10 min) | 1.2 | 1.2 | 1.2 | n/a |
| Comonomer | Butene | Butene | Butene | n/a |
| % comonomer | | | | n/a |
| DSC melting point (° C.) | 103 | 103 | 103 | n/a |
| % HDPE blended | 70 | 30 | 50 | 100 |
| Spin Conditions | | | | |
| Tunnel (A/B/None) | A | B | A | None |
| Accum pressure (psig) | 1650 | 1600 | 1625 | 1650 |
| Spin pressure (psig) | 1490 | 1450 | 1430 | 1525 |
| Spin Temperature (° C.) | 175 | 176 | 175 | 175 |
| Properties | | | | |
| Denier | 245 | 226 | 282 | 251 |
| Modulus (gpd) | 4.33 | 2.15 | 2.73 | 1.54 |
| Tensile (gpd) | 3.33 | 1.98 | 2.4 | 4.2 |
| Elongation (%) | 81 | 96 | 97 | 66 |
| Softness Rating (1–5) | 2 | 3 | 2.5 | 1 |

| | Ex. 25 | Ex. 26 | Ex. 27 | Ex. 28 |
|---|---|---|---|---|
| Copolymer | | | | |
| Density (g/cc) | n/a | n/a | n/a | n/a |
| Melt Index (g/10 min) | n/a | n/a | n/a | n/a |
| Comonomer | n/a | n/a | n/a | n/a |
| % comonomer | n/a | n/a | n/a | n/a |
| DSC melting point (° C.) | n/a | n/a | n/a | n/a |
| % HDPE blended | 100 | 100 | 100 | 100 |
| Spin Conditions | | | | |
| Tunnel (A/B/None) | None | None | None | None |
| Accum pressure (psig) | 1750 | 1550 | 1700 | 1650 |
| Spin pressure (psig) | 1525 | 1575 | 1425 | 1550 |
| Spin Temperature (° C.) | 176 | 175 | 175 | 176 |
| Properties | | | | |
| Denier | 295 | 239 | 240 | 230 |
| Modulus (gpd) | 1.12 | 2.09 | 6.1 | 1.63 |
| Tensile (gpd) | 4.02 | 4.23 | 4.56 | 4.44 |
| Elongation (%) | 70 | 72 | 76 | 84 |
| Softness Rating (1–5) | 1 | 1 | 1 | 1 |

| | Ex. 28 | Ex. 29 |
|---|---|---|
| Copolymer | | |
| Density (g/cc) | n/a | n/a |
| Melt Index (g/10 min) | n/a | n/a |
| Comonomer | n/a | n/a |
| % comonomer | n/a | n/a |
| DSC melting point (° C.) | n/a | n/a |
| % HDPE blended | 100 | 100 |

-continued

| | | |
|---|---|---|
| Spin Conditions | | |
| Tunnel (A/B/None) | None | B |
| Accum pressure (psig) | 1700 | 1650 |
| Spin pressure (psig) | 1550 | 1500 |
| Spin Temperature (° C.) | 176 | 176 |
| Properties | | |
| Denier | 257 | 277 |
| Modulus (gpd) | 13.8 | 6.66 |
| Tensile (gpd) | 5.09 | 4.34 |
| Elongation (%) | 87 | 95 |
| Softness Rating (1–5) | 1 | 1 |

Tests have also been run on pilot line equipment to make sheet products. On the pilot line for Example C1a, plexifilamentary polyethylene was flash spun from a solution consisting of 17.7% of high density polyethylene and 82.3% of a spin agent consisting of 32% cyclopentane and 68% normal pentane. The high density polyethylene had a melt index of 0.73 g/10 minutes (@190° C. with a 2.16 kg weight), a melt flow ratio {MI(@190° C. with a 2.16 kg weight)/MI (@190° C. with a 21.6 kg weight)} of 34, and a density of 0.96 g/cc. The polyethylene was obtained from Lyondell Petrochemical Company of Houston, Texas under the tradename ALATHON®. ALATHON® is currently a registered trademark of Lyondell Petrochemical Company. The solution was prepared in a continuous mixing unit and delivered at a temperature of 185° C., and a pressure of about 13.8 MPa (2000 psi) through a heated transfer line to an array of six spinning positions. Each spinning position has a pressure letdown chamber where the solution pressure was dropped to about 6.2 MPa (897 psi). The solution was discharged from each letdown chamber to a region maintained near atmospheric pressure and at a temperature of about 50° C. through a 0.871 mm (0.0343 in) spin orifice having a length to diameter of about 0.9. The flow rate of solution through each orifice was about 120 kg/hr (264 lbs/hr). The solution was flash spun into plexifilamentary film-fibrils that were laid down onto a moving belt, consolidated, collected as a loosely consolidated sheet on a take-up roll as described above.

The sheet was bonded on a Palmer bonder by passing the sheet between a moving belt and a rotating heated smooth metal drum with a diameter of about five feet. The drum is heated with pressurized steam and the bonding temperature is controlled by adjusting the pressure of the steam inside the drum. The pressurized steam heats the bonding surface of the drum to approximately 133 to 141° C. The pressure of the steam is used to adjust the temperature of the drum according to the degree of bonding desired. The bonded sheet has the opacity delamination and other properties as set forth in the following Table as Example C1a and examples C1b were created manner similar to C1a with differences as noted.

It should be noted that properties of the sheet vary as the bonding temperature is changed by adjusting the bonder steam pressure. Normally, delamination strength increases and opacity decreases as bonding temperature is increased. The bonding temperature required to attain a specified level of delamination strength or opacity depends on the polymer and spinning conditions used to make the unbonded precursor sheet. In order to make meaningful comparisons among samples, each of the sheet samples below were bonded over a range of temperatures yielding delamination strength values both less than and greater than 0.35 lb/in, and the properties at 0.35 lb/in delamination strength were then estimated using linear regression.

| | Ex. C1a | Ex. C1b | Ex. C2 |
|---|---|---|---|
| Copolymer | | | |
| Density (g/cc) | n/a | n/a | 0.910 |
| Melt Index (g/10 min) | n/a | n/a | 1.2 |
| Comonomer | n/a | n/a | Butene |
| DSC Melting Point (° C.) | n/a | n/a | 103 |
| % HDPE | 100 | 100 | 90 |
| Spin Conditions | | | |
| Concentration (%) | 17.7 | 17.9 | 18.6 |
| Temperature (° C.) | 185 | 185 | 185 |
| Letdown pressure (psig) | 897 | 893 | 856 |
| Bond Conditions (psia) | 47.3 | 47.8 | 47.3 |
| Properties | | | |
| Opacity (%) | 97.8 | 97.9 | 96.3 |
| Basis Weight (oz/yd$^2$) | 1.7 | 1.7 | 1.7 |
| Break Strength (lbs-yd$^2$/oz-in) | 18.2 | 16.7 | 18.5 |
| Break Elongation (%) | 16.9 | 14.8 | 19.2 |
| Toughness (lbs-yd$^2$/oz) | 9.9 | 8.3 | 11.5 |
| Elmendorf Tear (lbs) | 1.5 | 1.6 | 1.3 |
| Hydrostatic Head (inches) | 71.6 | 73.5 | 65.7 |
| Spencer Puncture (in-lb/in$^2$) | 23.5 | 19.8 | 23.5 |
| Elongation at 3 lb (%) | 0.81 | 0.58 | 0.62 |
| Softness Rating (1–7) | 1 | 1 | 2 |
| Quietness Rating (1–7) | 1 | 1 | 1 |

| | Ex. C3 | Ex. C4 | Ex. C5a | Ex. C5b |
|---|---|---|---|---|
| Copolymer | | | | |
| Density (g/cc) | 0.910 | 0.910 | 0.910 | 0.910 |
| Melt Index (g/10 min) | 1.2 | 1.2 | 1.2 | 1.2 |
| Comonomer | Butene | Butene | Butene | Butene |
| DSC Melting Point (° C.) | 103 | 103 | 103 | 103 |
| % HDPE | 80 | 70 | 60 | 60 |
| Spin Conditions | | | | |
| Concentration (%) | 17.8 | 17.5 | 16.9 | 19.0 |
| Temperature (° C.) | 185 | 185 | 185 | 185 |
| Letdown pressure (psig) | 867 | 897 | 903 | 832 |
| Bond Conditions (psia) | 44.2 | 43.9 | 41.8 | 43.3 |
| Properties | | | | |
| Opacity (%) | 94.1 | 94.4 | 93.1 | 90.8 |
| Basis Weight (oz/yd$^2$) | 1.7 | 1.7 | 1.7 | 1.7 |
| Break Strength (lbs-yd$^2$/oz-in) | 14.6 | 15.2 | 14.4 | 14.5 |
| Break Elongation (%) | 19.2 | 24.2 | 26.9 | 24.6 |
| Toughness (lbs-yd$^2$/oz) | 8.8 | 11.1 | 11.3 | 10.3 |
| Elmendorf Tear (lbs) | 1.4 | 1.2 | 1.2 | 1.2 |
| Hydrostatic Head (inches) | 51.9 | 49.0 | 45.3 | 39.6 |
| Spencer Puncture (in-lb/in$^2$) | 25.5 | 26.0 | 30.8 | 31.1 |
| Elongation at 3 lb (%) | 0.90 | 1.24 | 1.66 | 1.52 |
| Softness Rating (1–7) | 3 | 4 | 5 | 5 |
| Quietness Rating (1–7) | 2 | 4 | 5 | 5 |

| | Ex. C6 | Ex. C7 |
|---|---|---|
| Copolymer | | |
| Density (g/cc) | 0.925 | 0.925 |
| Melt Index (g/10 min) | 0.75 | 0.75 |
| Comonomer | Hexene | Hexene |
| DSC Melting Point (° C.) | 121 | 121 |
| % HDPE | 60 | 20 |
| Spin Conditions | | |
| Concentration (%) | 1 8 | 1 8 |
| Temperature (° C.) | 185 | 185 |
| Letdown pressure (psig) | 990 | 990 |
| Bond Conditions (psia) | 45.2 | 38.0 |
| Properties | | |
| Opacity (%) | 95.5 | 94.4 |
| Basis Weight (oz/yd$^2$) | 1.7 | 1.7 |

-continued

| | | |
|---|---|---|
| Break Strength (lbs-yd$^2$/oz-in) | 14.9 | 10.7 |
| Break Elongation (%) | 22.9 | 27.4 |
| Toughness (lbs-yd$^2$/oz) | 10.2 | 8.3 |
| Elmendorf Tear (lbs) | 1.4 | 1.1 |
| Hydrostatic Head (inches) | 47.3 | 23.2 |
| Spencer Puncture (in-lb/in$^2$) | 31.5 | 21.0 |
| Elongation at 3 lb (%) | 1.26 | 2.59 |
| Softness Rating (1–7) | 5 | 7 |
| Quietness Rating (1–7) | 4 | 7 |

In conclusion, flash spinning ethylene copolymer provides considerably softer and quieter flash-spun products. It should be particularly noted that adding what may appear to be small amounts of ethylene copolymer to HDPE also provides a substantial improvement in softness and quietness to the flash-spun products.

The foregoing description and drawings were intended to explain and describe the invention so as to contribute to the public base of knowledge. In exchange for this contribution of knowledge and understanding, exclusive rights are sought and should be respected. The scope of such exclusive rights should not be limited or narrowed in any way by the particular details and preferred arrangements that may have been shown. Clearly, the scope of any patent rights granted on this application should be measured and determined by the claims that follow.

We claim:

1. A soft polymeric flash-spun plexifilamentary material comprising an ethylene copolymer wherein the ethylene copolymer is made using single site catalysis and has a melt index from about 0.1 to about 50 g/10 min and a density of about 0.85 to about 0.95 g/cc and further wherein the flash-spun plexifilamentary material has a BET surface area of greater than 2 m$^2$/gm and molecular weight distribution of less than four.

2. The soft polymeric flash-spun plexifilamentary material according to claim 1 wherein the density of the ethylene copolymer is between about 0.87 and about 0.90 g/cc.

3. The soft polymeric flash-spun plexifilamentary material according to claim 1 wherein the melt index of the ethylene copolymer is between about 0.4 to about 10 g/10 min.

4. The soft polymeric flash-spun plexifilamentary material according to claim 1 wherein the BET surface area is greater than about 8 m$^2$/gm.

5. The soft polymeric flash-spun plexifilamentary material according to claim 1 wherein the molecular weight distribution of the ethylene copolymer is less than about 4.

6. A soft polymeric flash-spun plexifilamentary material comprising an ethylene copolymer blended with high density polyethylene polymer, wherein the ethylene copolymer has a melt index of between about 0.4 and about 10 g/10 min, a density between about 0.87 and about 0.93 g/cc, and a molecular weight distribution less than about 4, and wherein the plexifilamentary material has a BET surface area greater than about 8 m$^2$/gm.

7. A soft flash-spun nonwoven sheet material comprising an ethylene copolymer, wherein the ethylene copolymer is made using single site catalysis and has a density between about 0.85 to about 0.95 g/cc and a melt index between about 0.1 to about 50 g/10 min, and molecular weight distribution of less than four and wherein the flash spun nonwoven material has a BET surface area of greater than 2 m$^2$/gm and a breaking strength greater than 10 lb-yd$^2$/oz-in.

8. The soft flash-spun nonwoven sheet according to claim 7 wherein the sheet material is spunbonded.

9. The soft flash-spun nonwoven sheet according to claim 7 wherein the sheet material is area bonded.

10. The soft flash-spun nonwoven sheet according to claim 7 wherein the sheet material is point bonded.

11. The soft flash-spun nonwoven sheet according to claim 7 wherein the elongation at 3 lbs tension is greater than about one percent.

12. The soft flash-spun nonwoven sheet according to claim 7 having a hydrostatic head greater than about 20 inches.

13. The soft flash-spun nonwoven sheet according to claim 7 having a hydrostatic head greater than about 40 inches.

14. The soft flash-spun nonwoven sheet according to claim 7 having an opacity of at least 85%.

15. A soft polymeric flash-spun plexifilamentary material comprising an ethylene copolymer blended with high density polyethylene, wherein the ethylene copolymer has a melt index from about 0.1 to about 50 g/10 min and a density of about 0.85 to about 0.93 g/cc and further wherein the flash-spun plexifilamentary material has a BET surface area of greater than 2 $m^2$/gm.

16. A soft flash-spun nonwoven sheet material comprising an ethylene copolymer blended with high density polyethylene, wherein the ethylene copolymer has a density between about 0.85 to about 0.95 g/cc and a melt index between about 0.1 to about 50 g/10 min, and wherein the flash spun nonwoven material has a BET surface area of greater than 2 $m^2$/gm.

* * * * *